United States Patent [19]

Hipp

[11] Patent Number: 4,662,784

[45] Date of Patent: May 5, 1987

[54] METHOD OF INSTALLING PIPE STRINGS THROUGH OFFSHORE DRILLING PLATFORMS ALREADY IN PLACE

[76] Inventor: James Hipp, 110 Lietmeyer, New Iberia, La. 70560

[21] Appl. No.: 679,497

[22] Filed: Dec. 7, 1984

[51] Int. Cl.[4] ..... F16L 35/00

[52] U.S. Cl. ..... 405/169; 405/170; 405/195; 405/211

[58] Field of Search ..... 405/228, 196, 198, 204, 405/203, 205, 209, 228, 168, 169, 170

[56] References Cited

U.S. PATENT DOCUMENTS

| | | | |
|---|---|---|---|
| 1,267,129 | 5/1918 | Sewall | 405/228 |
| 3,448,511 | 6/1969 | Suter | 405/228 X |
| 3,717,002 | 2/1973 | O'Brien et al. | 405/170 |
| 3,860,122 | 1/1975 | Cernosek | 405/169 X |
| 4,068,490 | 1/1978 | Jegousse | 405/166 |

*Primary Examiner*—Dennis L. Taylor

*Attorney, Agent, or Firm*—Bernard A. Reiter; Mark G. Bocchetti

[57] ABSTRACT

Disclosed in a method of and apparatus for lowering pipe strings and other objects, particularly pipe strings carrying anodes for cathotic protection, into and through the support structure of an offshore plateform. Skid beams are inserted into the support structure of the offshore platform below the top deck of the platform and above the water level, preferably at the plus twelve level of the structure. Mounted to the skid beams are winch and derrick means. The skid beams are inserted into the structure such that the winch and derrick means are positioned over the point at which the pipe string is to be lowered through the structure. The skid beams cantilever out from the structure such that they extend well beyond the outside perimeter of the top deck. The skid beams also serve as track for a trolley. Pipe string sections can be delivered to the trolley either from the top deck of the platform or directly from a barge. The trolley transmports the pipe string sections, one at a time, to the winch and derrick means. The winch and derrick means are used to lift each pipe string section from the trolley and lower it through the support structure of the platform in substantially vertical position. As each section is lowered, it is temporarily supported so that the winch and derrick means may be used to lift and lower the next section. In such way, the pipe string sections to be welded to one another to form a continuous pipe string. The method is particularly useful in delivering anodes for cathotic protection to desired locations within the rigs support structure.

6 Claims, 5 Drawing Figures

METHOD OF INSTALLING PIPE STRINGS THROUGH OFFSHORE DRILLING PLATFORMS ALREADY IN PLACE

BACKGROUND OF THE INVENTION

1. Field of the Invention

The present invention relates to offshore drilling rigs and more particularly to the installation of a pipe string through an offshore drilling rig already in place to the sea floor.

2. Description of the Prior Art

Due to the nature and configuration of an offshore platform it is quite difficult to lower a pipe string or other such object through such a structure after its already in place. Such a structure is usually comprised of a series of support pipes which extend to and into the sea floor. At regular intervals there are located structural templates through which the support pipes extend. The result is that, particularly close to the surface, the unfilled gaps in such structural templates are quite small. Therefore, when it is found that an offshore rig requires additional cathodic protection, it is quite difficult to put in place additional anodes. Attempts to place and mount additional anodes have usually been made through the use of divers and/or submarines. This method has proved ineffective in deep water. When attempting to lower a pipe string or other such object from the top deck of the rig, it's quite difficult to place whatever is being lowered into the framework of the structure. This is because the top platform cantilevers well beyond the support structure at the point where the support structure meets the top platform. In the case of anodes, it is quite desirable to have them placed throughout the support structure and therefore in places which cannot possibly be reached by the use of cranes booming out from the top platform.

SUMMARY OF THE INVENTION

It is therefore an ojbect of the present invention to provide a method for installing cathodic protection on an already erected offshore platform.

A further object of the present invention is to provide a method by which pipe strings can be lowered through and mounted on an offshore platform support structure after the platform and support structure are already in place.

Briefly, the foregoing and other numerous features, objects and advantages of the present invention will become apparent upon careful reading of the detailed description, claims and drawings herein, wherein is described a method for installing pipe strings and other objects through the support structure of an offshort platform that is already in place. This is accomplished by mounting to the offshore rig support structure below the top deck, but above the water level, at a level commonly referred to as the plus twelve level, a pair of skid beams which cantilever out from the support structure well beyond the perimeter of the top deck. Mounted to the skid beams are a winch and derrick. The skid beams also serve as the track for a trolley. Joints of pipe strings or other objects desired to be lowered through the support structure may be lowered from the top deck of the platform to the trolley or the trolley may be loaded directly from a barge. A small winch is used to pull the trolley carrying the pipe string into position adjacent to the derrick. The joint of pipe string is then lifted into position using the main winch and lowered through the derrick. False rotary beams are used to support the joint by its lifting ears while another joint is lifted and lowered into position. The two joints are then welded together and lowered such that both joints are supported by the false rotary beams being braced against the lifting ears of the last lowered joint. Joints can be continually trollied in and lowered into position and welded so that ultimately the pipe string can be lowered to depths well in excess of 1,000 feet.

Because the skid beams and derrick can be relocated from spot to spot within the rig support structure, pipe strings can be lowered through the support structure at virtually any place where sufficient opening exists. Therefore, by affixing anodes to the pipe string being lowered, cathodic protection of the rig can be accomplished at particularly desirable locations or throughout the support structure.

The anode carrying pipe is lowered in a continuous string such that it is partially supported by the sea floor. A no-go ring is affixed to upper end of string and clamped to the support structure to provide the additional support required to hold the string in place. Once the string is permanently in place, each anode must be grounded to the rig structure.

DESCRIPTION OF THE PREFERRED EMBODIMENT

Figure 3:
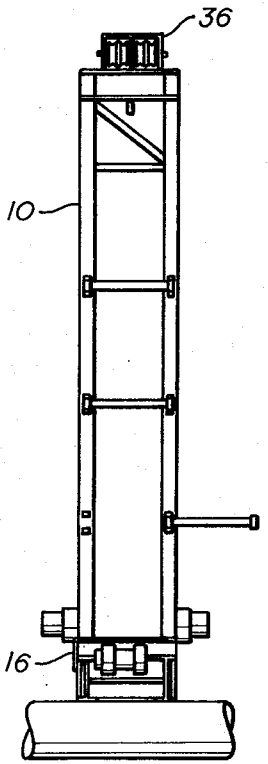
FIG. 3 is a side elevation of the derrick and winch as placed within the rigs structure.
Figure 1:
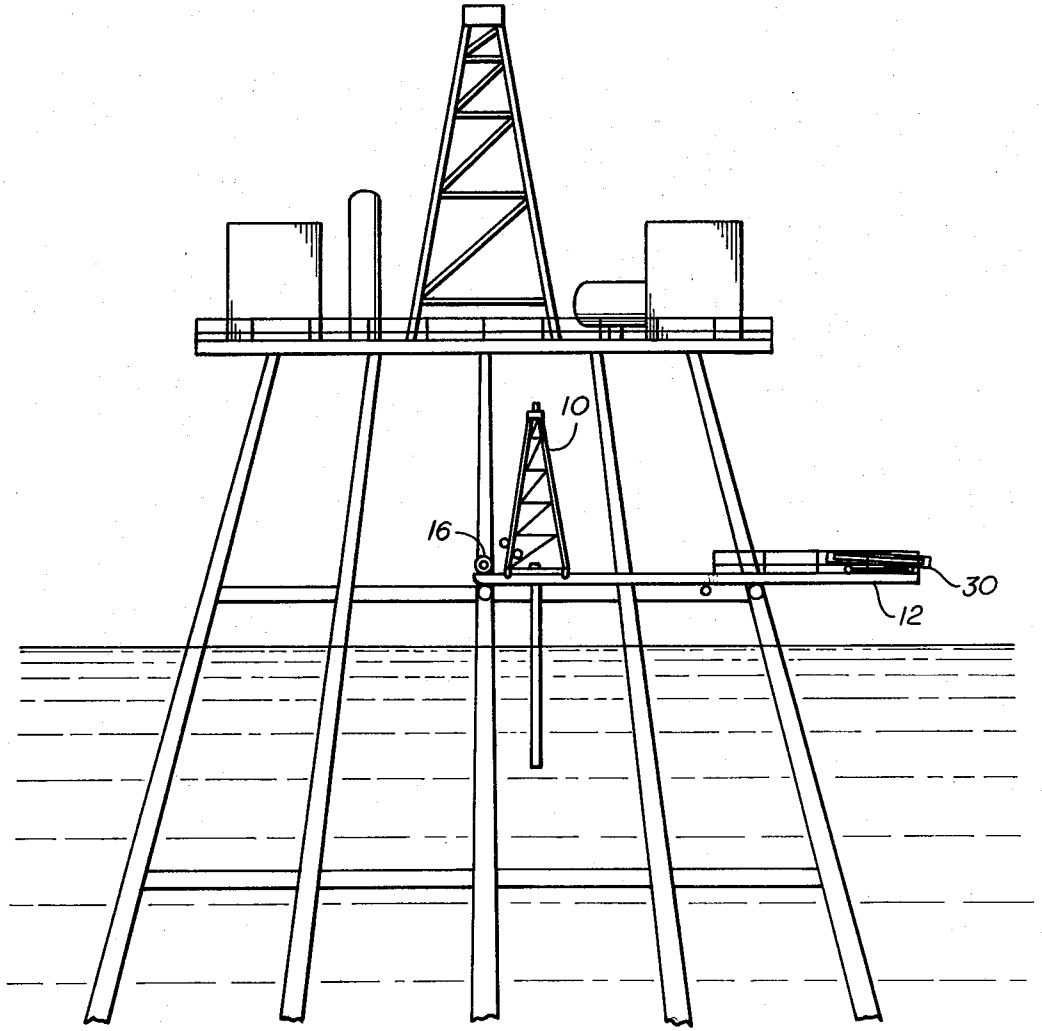
FIG. 1 is a front elevation of an offshore platform showing the apparatus installed at the plus twelve level necessary to practice the method of the present invention.
Figure 5:
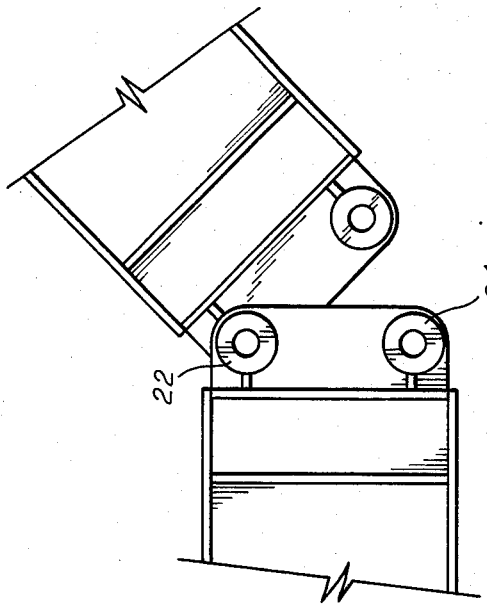
FIG. 5 is a detail of the hinged connection of the skid beams.
Figure 4:
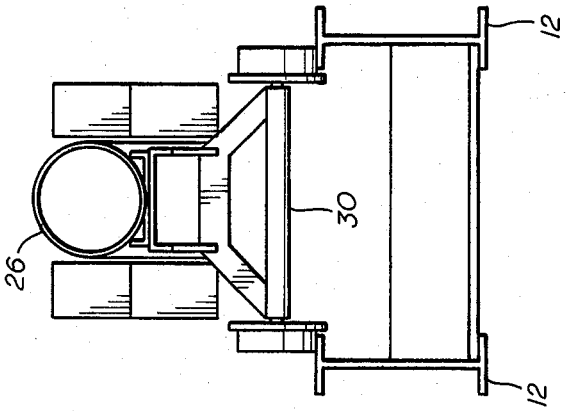
FIG. 4 is a cross section of the skid beams with the trolley located thereon.
Figure 2:
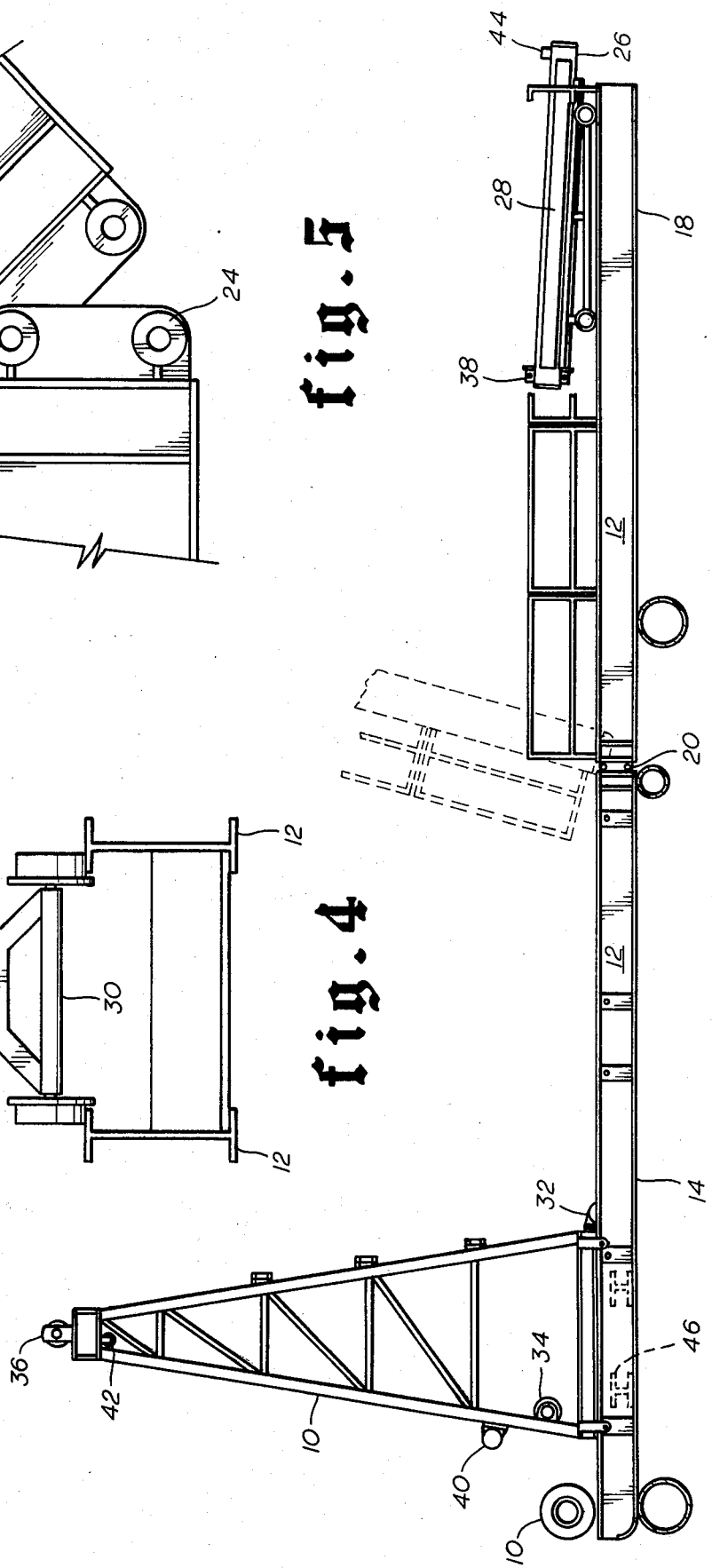
FIG. 2 is a front elevation of the skid beams, trolley, derrick and winch as placed within the rigs structure.

Turning first to FIG. 1, there shown an offshore platform having a derrick 10 and skid beams 12 placed within the structure of the rig below the top deck. Preferably, the skid beams are inserted at the plus twelve level of the platform and the derrick 10 mounted thereon. The skid beams 12 are divided into 2 seconds. There is a main section 14 to which the derrick 10 and winch 16 are mounted. There is a cantilever section 18 which extends from the rigs support structure beyond the outside perimeter of the top deck. The main section 14 and the cantilever section 18 of skid beams 12 are adjoined to one another by means of pivotal connection 20. Pivatol connection 20, shown in FIG. 5, has upper pin recepticals 22 and lower pin recepticals 24. By removing the pins from lower pin recepticals 24, cantilever section 18 of skid beam 12 can be rotated to a substantially vertical position. This is particularly useful when there exists severe weather conditions such that it would be imprudent to have such skid beams 12 extending out from the rig structure.

With the cantilever section 18 skid beams 12 in the horizontal position extending out from the rigs structure beyond the outside perimeter of the top deck, the skid beams 12 are accessible by crane from the top deck or from a barge. Therefore, a pipe section 26 having an anode 28 affixed thereto can be loaded onto the trolley 30 either from the top deck of the platform or directly from a barge carrying the pipe sections. The skid beams 12 serve as track for the trolley 30. A small winch 32 is used to pull trolley 30 loaded with pipe section 26 along skid beam 12 and into position adjacent to derrick 10. Winch 16 is used to lift each pipe section 26 from trolley 30. Cables from winch 16 feed through bottom sheave 34 and crown sheaves 36. Each pipe section 26 has mounted to it a set of lifting ears 38. The cables coming down from crown sheaves 36 are attached to lifting ears 38 and pipe section 26 is lifted off trolley 30 and into substantially vertical position within derrick 10. There is a tag line winch 40 mounted to the side of derrick 10. Cables from tag line winch 40 pass through tag line sheave 42 and are attached to tailing ear 44 mounted on pipe section 26. Tag line winch 40 enables the operator to control the end of the pipe string as it is lowered so that it is maintained in substantially vertical position. As each pipe section is lowered into and through the rig support structure, the lifting ears 38 are rested on false rotary beams 46 which extend across and rest at each end on the bottom flanges of skid beams 12. In this manner, false rotary beams 46 support the pipe sections previously lowered while the cables from main winch 16 are detached from lifting ears 38. The lowered pipe string is thus held in position while the next pipe section 26 is lifted by main winch 16 into vertical position so that it can be welded to the pipe section 26 last lowered. The false rotary beams 46 are then slid out from under lifting ears 38 and the entire pipe string is again lowered by the length of one pipe section 26 at which point the lifting ears 38 of the joined pipe section 26 are supported by false rotary beams 46.

Trolley winch 32 pulls trolley 30 loaded with pipe section 26 into position adjacent to derrick 10. Once pipe section 26 has been lifted from trolley 30, trolley winch 32 is used to pull trolley 30 back out onto cantilever section 18 of skid beam 12 so that trolley 30 can receive the next pipe section 26.

It can be seen that by using the method of the present invention a pipe string having anodes attached thereto to supply cathotic protection to an offshore rig can be lowered through the support structure of the rig at any point where the opening through the structure is of sufficient dimensions to allow the pipe string and anode to pass there through. It is envisioned that in the preferred embodiment the pipe string will be lowered so that it is at least partially supported by the sea floor. A no-go ring will be welded to the top pipe section 26 and clamped to the rigs support structure below the water level.

Because the method of the present invention uses skid beams, the equipment necessary to practice the method can be moved around on the plus 12 level of the rig to virtually any point at which it is desired to lower cathotic protection. Once a pipe string is in place with the combined support of the sea floor and the clamped no-go ring, it is necessary to ground each anode 28 to the rig support structure in order for the cathotic protection to properly function.

It should be recognized that the lowering of anodes or pipe strings having an anodes attached thereto from the top deck of the platform is quite impossible for the reason of the congestion of equipment and support structure at that level. Further, it should be recognized that the method of the present invention is much more efficient in regard to both time and money than is the use of a submarine or divers to place each individual anode.

From the foregoing, it will be seen that this invention is one well adapted to attain all the ends and objects hereinabove set forth, together with other advantages which are obvious and which are inherent to the apparatus.

It will be understood that certain features and sub-combinations are of utility and may be employed with reference to other features and sub-combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed:

1. An apparatus for placing anode carrying pipe strings and other objects into and through an offshore platform support structure comprising:

a. a plurality of skid beams slidably placed into the offshore platform support structure below the top deck and above the water level having distal ends extending outwardly from the rig support structure;

b. a trolley for receiving and carrying the pipe string sections along said skid beams from said distal end of said skid beams into the support structure to the point at which the pipe string is lowered vertically through the support structure;

c. a winch and derrick mounted to said skid beams for removing each pipe string section from said trolley and subsequently lowering that pipe string section into and through the support structure.

2. An apparatus as recited in claim 1, further comprising a static support means for supporting the last lowered pipe string section while said lifting means positions the next pipe string section to be lowered.

3. An apparatus as recited in claim 1 wherein:

each of said skid beams is comprised of a main section and a cantilever section, said cantilever sections being pivotally connected to said main sections so that said cantilever sections can be pivoted into upright position such that said cantilever sections do not extend beyond the top deck.

4. An apparatus for placing anode carrying pipe strings and other objects into and through an offshore platform support structure comprising:

a. a plurality of skid beams slidably placed into the offshore platform support structure below the top deck and above the water level having distal ends extending outwardly from the rig support structure;

b. trolley means for receiving and carrying the pipe string sections along said skid beams from said distal ends of said skid beams into the support structure to the point at which the pipe string is to be lowered vertically through the support structure;

c. a winch and derrick mounted to said skid beams, said winch and derrick being used to raise, lower and support the pipe string sections.

5. An apparatus for placing anode carrying pipe strings and other objects into and through and offshore platform support structure as recited in claim 4, wherein:

each of said skid beams is comprised of two pivotally connected sections thereby allowing said distal ends of said skid beams to be rotated to upright position so as to not extend beyond the top deck of the offshore platform.

6. An apparatus for placing anode carrying pipe strings and other objects into and through an offshore platform support structure as recited in claim 5, further comprising:

a plurality of beams slidably engaging said skid beams for supporting the last lowered pipe string section while said winch and derrick positions the next pipe string section to be lowered.

* * * * *